US007397336B2

(12) United States Patent
Kawarai

(10) Patent No.: US 7,397,336 B2
(45) Date of Patent: Jul. 8, 2008

(54) COIL COMPONENT

(75) Inventor: Mitsugu Kawarai, Tokyo (JP)

(73) Assignee: Sumida Electric Co., Ltd., Tokyo (JP)

( * ) Notice: Subject to any disclaimer, the term of this patent is extended or adjusted under 35 U.S.C. 154(b) by 261 days.

(21) Appl. No.: 11/556,848

(22) Filed: Nov. 6, 2006

(65) Prior Publication Data

US 2007/0109087 A1 May 17, 2007

(30) Foreign Application Priority Data

Nov. 11, 2005 (JP) ..... P2005-327766

(51) Int. Cl.
*H01F 5/00* (2006.01)

(52) U.S. Cl. ..... 336/200

(58) Field of Classification Search ..... 336/65, 336/83, 200, 232–233; 29/602.1, 605, 621
See application file for complete search history.

(56) References Cited

U.S. PATENT DOCUMENTS 3,671,793 A * 6/1972 Scarlett ..... 257/773
4,767,901 A * 8/1988 Goyarts ..... 200/306
5,072,508 A * 12/1991 Kaneko et al. ..... 29/605
5,457,872 A * 10/1995 Sakata et al. ..... 29/605
7,078,988 B2 * 7/2006 Suzuki et al. ..... 333/181

FOREIGN PATENT DOCUMENTS

JP 06-120050 4/1994
JP 2002-324714 11/2002

* cited by examiner

*Primary Examiner*—Tuyen T. Nguyen
(74) *Attorney, Agent, or Firm*—Sonnenschein Nath & Rosenthal LLP

(57) ABSTRACT

Disclosed is a coil component having a magnetic core that is made of a magnetic material, and a terminal electrode portion and a coil portion that are made of a conductive material, wherein the coil components is configured such that the magnetic material and the conductive material contact with each other, and there is a relation of $R_M \geqq 20Z_O$ when an insulation resistance of the magnetic core is $R_M$ (Ω) and a peak impedance of the coil component is $Z_O$ (Ω).

2 Claims, 9 Drawing Sheets

COIL COMPONENT

CROSS REFERENCES TO RELATED APPLICATIONS

The present application claims priority to Japanese Application No. P2005-327766 filed on Nov. 11, 2005, which application is incorporated herein by reference to the extent permitted by law.

BACKGROUND OF THE INVENTION

1. Field of the Invention

The present invention relates to a coil component on the whole, and mainly relates to a coil component that is used for a power supply circuit.

2. Description of the Related Art

In recent years, there is a strong requirement for higher performance especially to a coil component that is mounted on a power supply system circuit in order to improve DC BIAS characteristics, and it is known to use a material whose maximum saturated magnetic flux density Bm is high as a material of a magnetic core in order to cope with this requirement.

A manganese type ferrite magnetic material and a metal type magnetic material can be listed as the material having the high maximum saturation magnetic flux density Bm. However, since an insulation resistance value specific to the material is low in case of those materials, it is known to use a conductor having an insulation coating film on a surface as shown in Patent Reference 1, for example, when a coil component is manufactured by using those materials.

In addition, it is also known that a magnetic core used for a coil component is coated with an insulating paint and the like as shown in Patent Reference 2.

[Patent Reference 1] Japanese Unexamined Patent Publication No. 2002-324714

[Patent Reference 2] Japanese Unexamined Patent Publication No. H06-120050

SUMMARY OF THE INVENTION

However, since the coil component described in the Patent Reference 1 needs to form the insulation coating film on the conductor at the time of manufacturing the conductor of a coil portion, there arises a problem of an increase in manufacturing process and increase in cost related thereto.

In addition, since it is necessary to remove the insulation coating film corresponding to a portion that becomes a terminal electrode portion or a portion that connects with a terminal electrode out of the insulation coating film formed over a whole area of the conductor surface, there also arises a problem of an increase in manufacturing process therefor and increase in cost related thereto.

Also, the coil component described in the Patent Reference 2 is such coil component that a surface of the magnetic core is coated with an insulating resin in order to secure insulation between the magnetic core and the coil portion, however there arises a problem of an increase in coating process and increase in cost related thereto.

Furthermore, in the coil component described in the Patent Reference 2, there also arises a problem such as an insulation failure of the coil component due to a variation in coating and thickness of the insulation coating film which occurs at the time of coating process.

In view of the above-described problems, an object of the present invention is to provide with such a coil component that there is no need to arrange an insulation member between a magnetic core and a coil portion.

Such an object can be achieved by embodiments according to the present invention described in following items (1) and (2).

(1) A coil component including:

a magnetic core that is made of a magnetic material; and a terminal electrode portion and a coil portion that are made of a conductive material, wherein the coil component is configured such that the aforesaid magnetic material and the aforesaid conductive material contact with each other, and there is a relation of $$R_M \geqq 20Z_O$$

when an insulation resistance of the aforesaid magnetic core is $R_M$ (Ω) and a peak impedance of the aforesaid coil component is $Z_O$ (Ω).

(2) A coil component described in the above item (1), wherein the aforesaid coil portion is composed of a flat board-shaped member.

Since it is not necessary to arrange the insulation member between the magnetic core and the coil portion according to the embodiments of the present invention, a forming process of the insulation portion in the conductor or the magnetic core can be eliminated so that manufacturing costs of coil component can be reduced.

DESCRIPTION OF THE PREFERRED EMBODIMENTS

Preferred embodiments of the coil component according to the present invention are explained hereinafter by referring to the accompanied drawings, however it should be noted that the present invention is not limited to the following embodiments.

Figure 1:
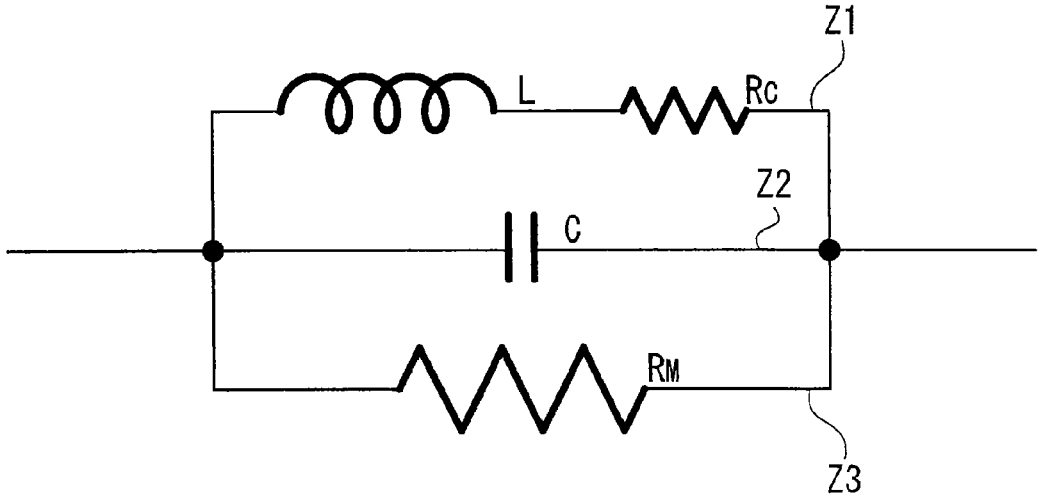
FIG. 1 is a diagram showing schematically an equivalent circuit of a coil component according to an embodiment of the present invention.
Figure 2A:
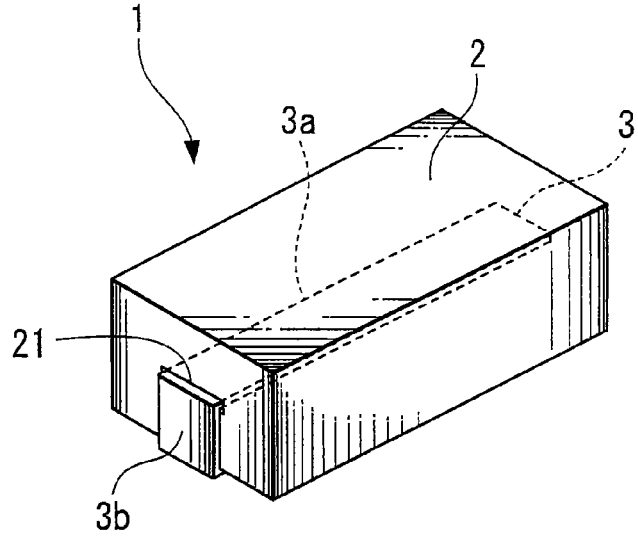
FIGS. 2A to 2D are diagrams of a coil component according to a first embodiment of the present invention.
Figure 2B:
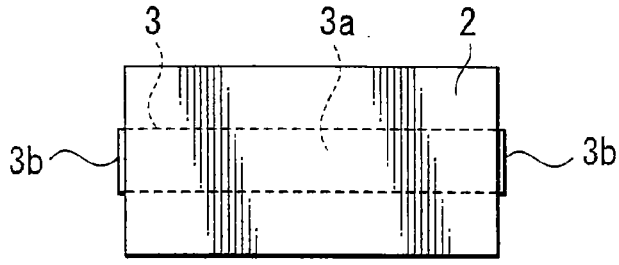
Figure 2C:
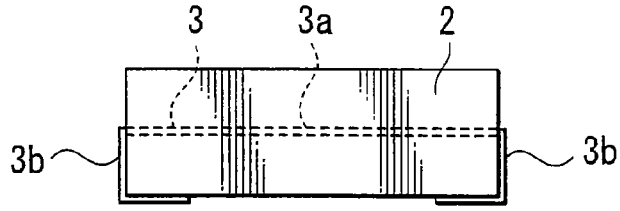
Figure 2D:
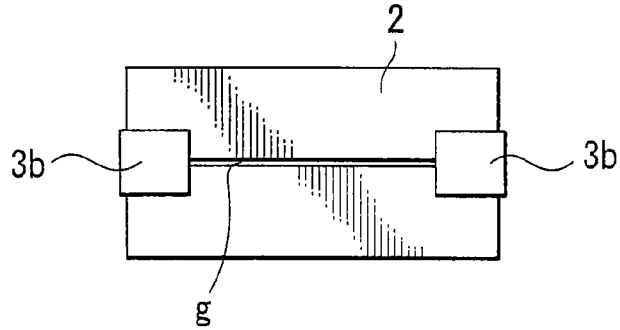

FIG. 1 is a diagram showing schematically an equivalent circuit of the coil component according to the embodiment of the present invention.

When the equivalent circuit as shown in FIG. 1 is used to consider a configuration of the coil component, an impedance Z of the coil component according to the embodiment of the present invention can be regarded as a parallel resistance made up of;

Z1: series resistance of inductance L and DC resistance $R_C$ of coil component

Z2: stray capacitance C

Z3: insulation resistance $R_M$ of magnetic core

In addition, a frequency characteristic of the impedance Z of the coil component can be obtained by expression (1) through expression (4) shown in the following formula 1.

[Formula 1]

$$Z1 = X_L + R1 = [2\pi f \cdot L] + Rc \quad (1)$$

$$Z2 = X_C = \frac{1}{[2\pi f \cdot C]} \quad (2)$$

$$Z3 = R_M \quad (3)$$

$$Z = \frac{1}{\left[\frac{1}{Z1} + \frac{1}{Z2} + \frac{1}{Z3}\right]} \quad (4)$$

As to notations used in each expression of the formula 1, the DC resistance $R_C$ of the coil component means R-Coil and the insulation resistance $R_M$ of the magnetic core means R-Magnetic. In addition, the impedance Z in a resonant frequency $f_O$, which is described later, is to be treated as a peak impedance $Z_O$.

For example, the smaller becomes Z3 in the expression (3) of the formula 1 which means the insulation resistance $R_M$ of the magnetic core, the larger a value of 1/Z3 in the expression (4) becomes, and as a result thereof the impedance Z of this coil component is brought to a direction of decrease and the peak impedance $Z_O$ in the resonant frequency $f_O$ also decreases. More specifically, the coil component is brought into a state where an electric current can flow easily in the magnetic core. Then, insulation processing between the conductor and the magnetic core which are used in the coil component becomes necessary in that case.

On the contrary, when the insulation resistance $R_M$ of the magnetic core has a value equal to or more than an insulation resistance of general nickel type ferrite, for example (an insulation resistance obtained from $\rho > 10^7 \Omega \cdot cm$ where ρ is the resistivity specific to the material, for example), the value of 1/Z3 in the expression (4) becomes small. Consequently, the electric current does not flow in the magnetic core since the insulation resistance $R_M$ of the magnetic core rarely affects the impedance Z and peak impedance $Z_O$ of the coil component. Then, the insulation processing between the conductor and the magnetic core which are used in the coil component becomes unnecessary in that case.

As described hereinbefore, when the insulation resistance $R_M$ of the magnetic core is within a range that does not affect the impedance Z and peak impedance $Z_O$ of the coil component which are obtained by the expression (1) through the expression (4) shown in the formula 1, theoretically the electric current that flows the coil component passes through only the conductor without flowing the magnetic core even if the insulation processing is not applied between the conductor and the magnetic core, and therefore it becomes possible to secure a desired electrical characteristic of the coil component.

First Embodiment

First, a first embodiment of the coil component according to the present invention is explained.

FIG. 2 is a diagram of the coil component according to the first embodiment of the present invention. FIG. 2A is a perspective view; FIG. 2B is a top view; FIG. 2C is a lateral view; and FIG. 2D is a bottom view.

As shown in FIG. 2, a coil component 1 of this embodiment is configured to have a magnetic core 2 made up of a cylinder-shaped rectangular ferrite type core and a belt-shaped conductor 3.

In this embodiment, the conductor 3 is inserted into a hole portion 21 that is formed in an approximately central part of the magnetic core 2 and a flat board-shaped coil portion 3*a* is formed in the inside of the magnetic core 2. In addition, a terminal electrode portion 3*b* is formed by a process of bending the conductor 3 that is exposed to the outside of the magnetic core 2.

The conductor 3 is composed of a conductive material. In this embodiment, the coil component 1 is configured such that the conductive material of the conductor 3 contacts directly with the magnetic material of the magnetic core 2 since an insulation portion such as an insulation coating film is not formed on the conductor 3.

In addition, a magnetic gap g is formed between the coil portion 3*a* and a surface of the magnetic core 2.

In table 1, measurement results of the peak impedance $Z_O$ (Ω) are shown in a case that the coil component 1 of this embodiment is measured under a condition that values of inductance L (μH), DC resistance $R_C$ (Ω) of the coil component and stray capacitance C (pF) are fixed and only a value of insulation resistance $R_M$ (Ω) of the magnetic core is changed.

TABLE 1

| Item | Unit | Reference Value | A | B | C | a | b |
|---|---|---|---|---|---|---|---|
| L | μH | 0.1 | 0.1 | 0.1 | 0.1 | 0.1 | 0.1 |
| $R_C$ | mΩ | 0.9 | 0.9 | 0.9 | 0.9 | 0.9 | 0.9 |
| C | pF | 0.005 | 0.005 | 0.005 | 0.005 | 0.005 | 0.005 |
| $R_M$ | Ω | $1.0 \times 10^{10}$ | 997926 | 227821 | 43919 | 22572 | 15000 |
| $Z_0$ | Ω | 2236 | 2231 | 2214 | 2132 | 2052 | 1945 |
| versus Reference Value [%] | | | −0.2 | −1.0 | −4.6 | −8.2 | −13.0 |
| versus Reference Value [Times] | | | 447.3 | 102.9 | 20.6 | 11.0 | 7.7 |

A: Embodiment Sample A, B: Embodiment Sample B, C: Embodiment Sample C, a: Comparison sample a. b: Comparison Sample b Here, a range where the insulation resistance $R_M$ of the magnetic core does not affect the peak impedance $Z_O$ of the coil component is to be defined. This range is to be such a range that has the peak impedance $Z_O$ within −5% from the reference value when the peak impedance $Z_O$ of the coil component obtained at the time of setting the insulation resistance $R_M$ into $10^{10}$ Ω (assuming a sufficiently high value as a realistic insulation resistance value of the magnetic core) is the reference value.

Here, the reason that the range within −5% of the reference value is prescribed as this range is based on the ground that there actually exist variations in conductor's own DC resistance and magnetic characteristic of the magnetic core within the range of around 5% and those variations are considered to cause the value of the peak impedance $Z_O$ to fluctuate around 5%.

Therefore, even if the peak impedance $Z_O$ fluctuates within 5% from the reference value depending on the value of insulation resistance $R_M$ of the magnetic core, it is judged to be within an allowable range as the performance of the coil component in the measurement of the coil component in this embodiment.

As is clear from the result of the table 1 (versus reference value %), the insulation resistance values $R_M$ of the magnetic cores in the coil components of the embodiment samples A through C related to this first embodiment are respectively the values of 447 times, 103 times and 21 times of the peak impedance $Z_O$ of each coil component, and there exists the relation of $R_M \geqq 20Z_O$ in every case.

In addition, the peak impedances $Z_O$ of the embodiment sample A through the embodiment sample C are within the range of −5% from the reference value as shown in the result of the table 1 and therefore within the above-described allowable range in every case.

From the above, it can be considered that an influence ($Z_O$ decrease rate) to be given to the peak impedance $Z_O$ of the coil component by the insulation resistance value $R_M$ in each of the embodiment sample A through the embodiment sample C is small in the coil components according to the embodiment sample A through the embodiment sample C. Therefore, it can be judged that there is no need to apply the insulation processing between the conductor and the magnetic core in this coil component.

On the other hand, in the coil components of the comparison sample a and comparison sample b whose insulation resistance values $R_M$ of the magnetic cores are respectively 11 times and 13 times of the peak impedance $Z_O$ of each coil component, each peak impedance $Z_O$ thereof becomes larger than the range of −5% from the reference value as shown in the result of the table 1.

This is because it is considered that the influence to be given to the peak impedance $Z_O$ by the insulation resistance $R_M$ of each magnetic core becomes large in case of the coil components of the comparison sample a and comparison sample b. Therefore, it can be judged that the insulation processing needs to be applied between the conductor and the magnetic core in case of the coil components of the comparison sample a and comparison sample b.

Based on this result, it can be judged that there is no need to apply the insulation processing between the conductor and the magnetic core in this coil component as long as there exists such relation that the insulation resistance $R_M$ of the cylinder-shaped rectangular core is equal to or more than 20 times of the peak impedance $Z_O$ of the coil component ($R_M \geqq 20Z_O$) in the coil component of the first embodiment.

Figure 3:
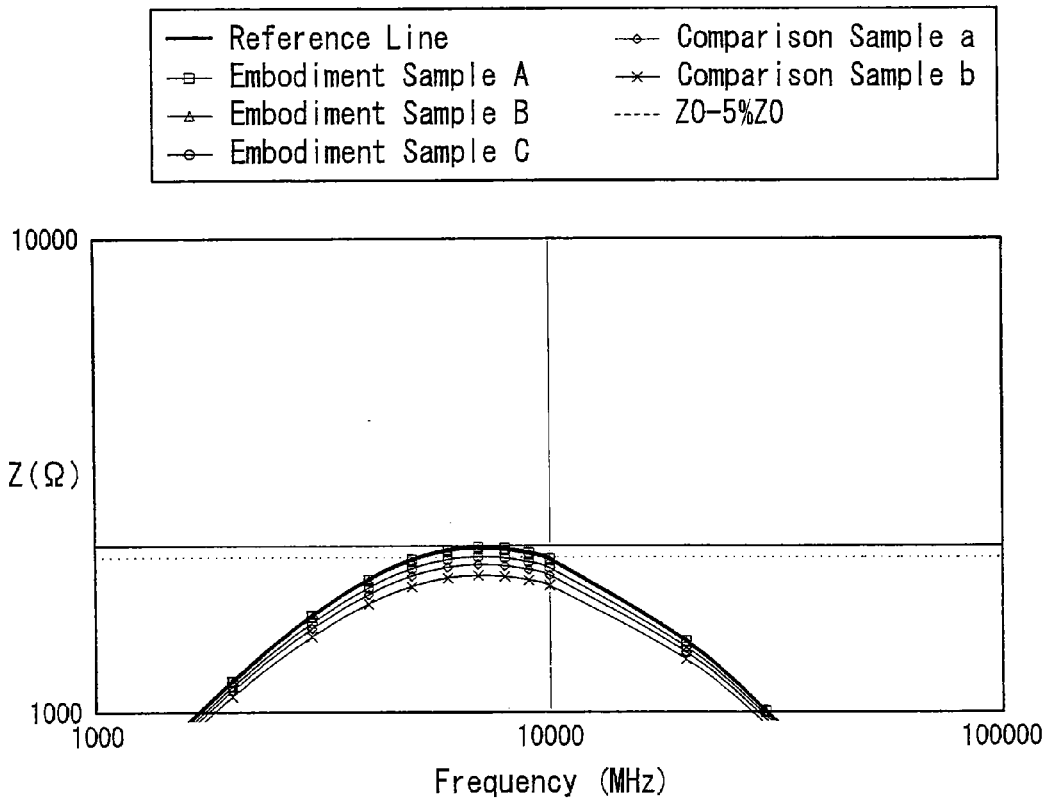
FIG. 3 is a graph showing a frequency characteristic of an impedance Z obtained by a measurement for each of the coil components shown in table 1.
Figure 4A:
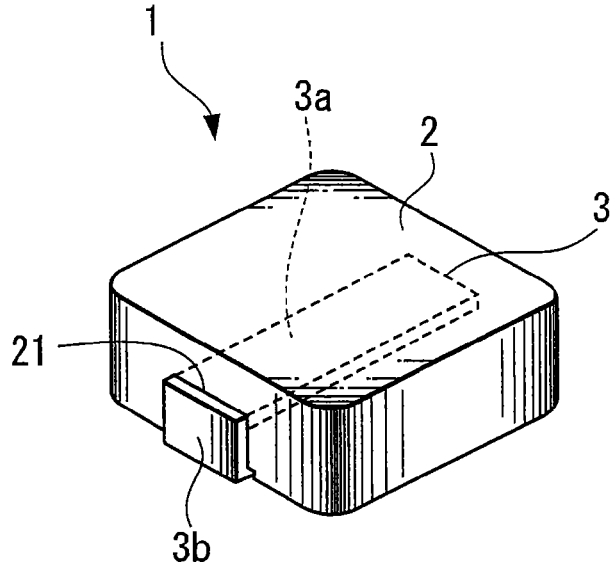
FIGS. 4A to 4D is diagrams of a coil component according to a second embodiment of the present invention.
Figure 4B:
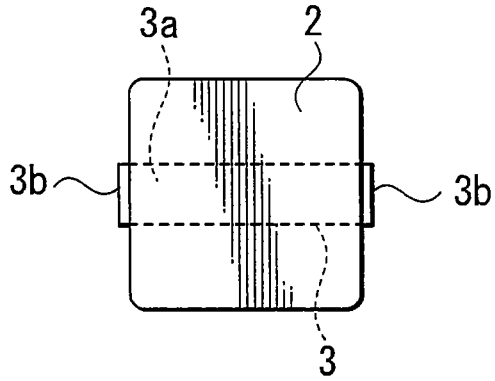
Figure 4C:
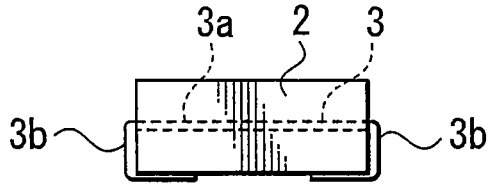
Figure 4D:
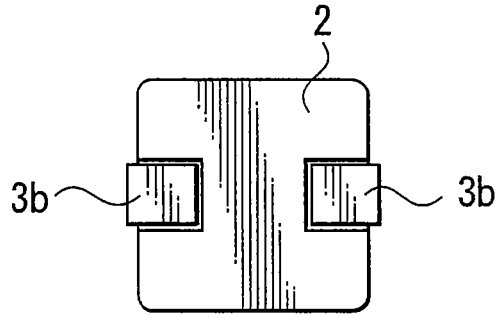

Also, FIG. 3 is a graph showing a frequency characteristic of the impedance Z obtained by the measurement for each of the coil components shown in the table 1. It should be noted that a solid line parallel with a lateral axis shown in the graph indicates a reference line and a dashed line indicates the range of −5% from the reference line.

Here, as is clear from the graph of FIG. 3, the frequency characteristic of the impedance Z in each of the coil components according to the embodiment samples A and B is approximately overlapped with the frequency characteristic of the reference value. From this fact, it can be said that the coil components of the embodiment sample A and embodiment sample B are those close to an ideal value (reference value).

More specifically, as long as there is such a relation that the insulation resistance $R_M$ of the cylinder-shaped rectangular core is equal to or more than 100 times of the impedance $Z_O$ of the coil component ($R_M \geqq 100Z_O$), the graph shows the frequency characteristic that is approximately equivalent to the impedance characteristic at the time of assuming the insulation resistance to be sufficiently high for a practical use, and therefore it can be judged to be an especially desirable condition.

Second Embodiment

Next, a second embodiment of the coil component according to the present invention is explained.

FIG. 4 is a diagram of the coil component according to the second embodiment of the present invention. FIG. 4A is a perspective view; FIG. 4B is a top view; FIG. 4C is a lateral view; and FIG. 4D is a bottom view.

As shown in FIG. 4, a coil component 1 of this embodiment is configured to have a cubic type magnetic core 2 whose upper surface and lower surface are made into an approximately square shape and a belt-shaped conductor 3.

The magnetic core 2 is formed by a powder compacting process after mixing a metal type powder of a magnetic material and an insulating resin tying agent. In addition, the conductor 3 is composed of a conductive material.

A flat board-shaped coil portion 3*a* is formed such that the belt-shaped conductor 3 is disposed in an approximately central part of the magnetic core 2. In addition, a terminal electrode portion 3*b* is formed by a process of bending the conductor 3 that is exposed to the outside of the magnetic core 2.

According to the coil component 1 of this embodiment, an insulation portion such as an insulation coating film is not formed on the conductor 3, and therefore the coil component 1 is configured such that the conductive material of the coil portion 3*a* contacts directly with the magnetic material of the magnetic core 2.

In table 2, measurement results of the peak impedance $Z_O$ of the coil component are shown in a case that the coil component 1 of this embodiment is measured under a condition that values of inductance L, DC resistance $R_C$ of the coil component and stray capacitance C are fixed and only a value of insulation resistance $R_M$ of the magnetic core is changed.

TABLE 2

| Item | Unit | Reference Value | D | E | F | c | d |
|---|---|---|---|---|---|---|---|
| L | μH | 0.07 | 0.07 | 0.07 | 0.07 | 0.07 | 0.07 |
| $R_C$ | mΩ | 0.3 | 0.3 | 0.3 | 0.3 | 0.3 | 0.3 |
| C | pF | 0.001 | 0.001 | 0.001 | 0.001 | 0.001 | 0.001 |
| $R_M$ | Ω | $1.0 \times 10^{10}$ | 992138 | 415769 | 79998 | 41288 | 20143 |
| $Z_0$ | Ω | 4178 | 4161 | 4137 | 3980 | 3823 | 2616 |
| versus Reference Value [%] | | | −0.4 | −1.0 | −4.7 | −8.5 | −11.6 |
| versus Reference Value [Times] | | | 239.3 | 100.5 | 20.1 | 10.8 | 7.7 |

D: Embodiment Sample D, E: Embodiment Sample E, F: Embodiment Sample F, c: Comparison sample c. d: Comparison Sample d At this time, a definition with the ground thereof relating to a range where the insulation resistance $R_M$ of the magnetic core 2 does not affect the peak impedance $Z_O$ of the coil component 1 is similar to the case of the first embodiment.

As is clear from the result of the table 2, the insulation resistance values $R_M$ of the magnetic cores in the coil components of the embodiment samples D through F related to this second embodiment are respectively values of 239 times, 100 times and 20 times of the peak impedance $Z_O$ of each coil component, and there exists the relation of $R_M \geqq 20Z_O$ in every case.

In addition, the peak impedance $Z_O$ in each of the embodiment sample D through the embodiment sample F is within the range of −5% from the reference value as shown in the result (versus reference value %) of the table 2.

From the above, it can be considered that an influence ($Z_O$ decrease rate) to be given to the peak impedance $Z_O$ of the coil component by the insulation resistance $R_M$ of each embodiment sample is small in the coil components of the embodiment sample D through the embodiment sample F. Therefore, it can be judged that there is no need to apply the insulation processing between the conductor and the magnetic core in the coil components of the embodiment samples D through F.

On the other hand, in case of the coil components of the comparison sample c and comparison sample d whose insulation resistance values $R_M$ of the magnetic cores are respectively 11 times and 8 times of the peak impedance $Z_O$ of each coil component, the value of each peak impedance $Z_O$ becomes larger than the range of −5% from the reference value as shown in the result of the table 2.

This is because it is considered that the influence to be given to the peak impedance $Z_O$ by the insulation resistance $R_M$ of each magnetic core is large in the coil components of the comparison sample c and comparison sample d. Therefore, it can be judged that the insulation processing needs to be applied between the conductor and the magnetic core in the coil components of the comparison sample c and comparison sample d.

Based on this result, it can be said that there is no need to apply the insulation processing between the conductor and the magnetic core in the coil component of the second embodiment as long as there exists such relation that the insulation resistance $R_M$ of the magnetic core 2 formed by the powder compacting process after mixing the metal type powder and the insulating resin tying agent is equal to or more than 20 times of the peak impedance $Z_O$ of the coil component 1 ($R_M \geqq 20Z_O$).

Figure 5:
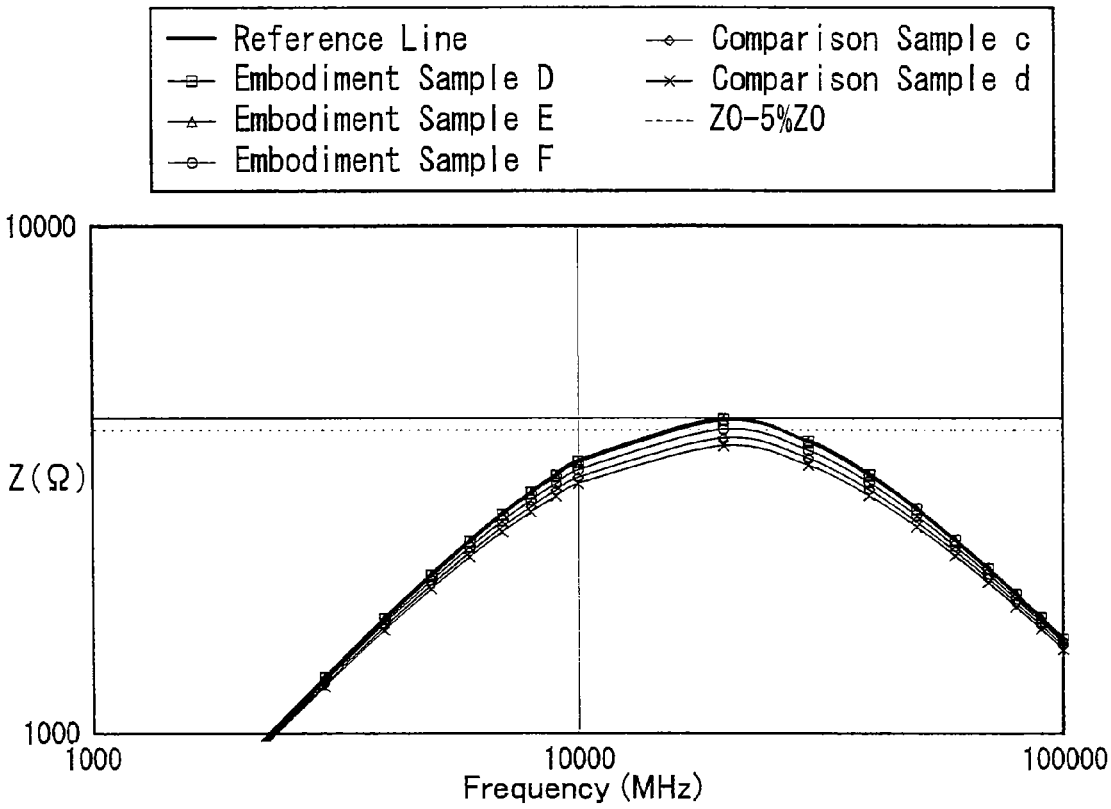
FIG. 5 is a graph showing a frequency characteristic of the impedance Z obtained by a measurement for each of the coil components shown in table 2.

FIG. 5 is a graph showing a frequency characteristic of the impedance Z obtained by the measurement for each of the coil components shown in the table 2.

Here, it can be noticed that the frequency characteristic of the impedance Z in each of the coil components according to the embodiment samples D and E is approximately overlapped with the frequency characteristic of the reference value as is clear from the graph of FIG. 5. Therefore, it can be said that the coil components of the embodiment sample D and embodiment sample E are those close to an ideal value (reference value).

Accordingly, as long as the insulation resistance $R_M$ of the powder compacting magnetic core 2 is equal to or more than 100 times of the impedance $Z_O$ of the coil component ($R_M \geqq 100Z_O$), the graph shows the frequency characteristic that is approximately equivalent to the impedance characteristic at the time of assuming the insulation resistance to be sufficiently high for a practical use, and therefore it can be said to be a further desirable condition.

Third Embodiment

Next, a third embodiment of the coil component according to the present invention is explained.

FIG. 6 is a diagram of the coil component according to the third embodiment of the present invention. FIG. 6A is a perspective view; FIG. 6B is a top view; FIG. 6C is a lateral view; and FIG. 6D is a bottom view. In addition, FIG. 6E is a partial cross-sectional view of the coil component.

As shown in FIG. 6, a coil component 1 of this embodiment is configured to have a cubic type magnetic core 2 whose upper surface and lower surface are made into an approximately square shape, a coil portion 3*a* that is buried in the magnetic core 2, and a belt-shaped terminal member 3*b* that is connected with this coil portion 3*a*.

The magnetic core 2 is formed by the powder compacting process after mixing a metal type powder of a magnetic material and an insulating resin tying agent. In addition, the coil portion 3*a* and the terminal member 3*b* are composed of a conductive material.

The coil portion 3*a* is formed such that the conductor is wound into an air core in a manner winding spirally and also having separation gaps. In addition, the terminal electrode portion 3*b* is formed by a process of bending the conductor along an external wall of the magnetic core 2.

According to the coil component 1 of this embodiment, an insulation coating film is not formed on the coil portion 3*a* and the terminal electrode portion 3*b* which are the conductors, and therefore this coil component 1 is configured such that the conductive materials of the coil portion 3*a* and terminal electrode portion 3*b* contact directly with the magnetic material of the magnetic core 2.

In table 3, measurement results of the peak impedance $Z_O$ of the coil component are shown in a case that the coil component 1 of this embodiment is measured under a condition that values of inductance L, DC resistance $R_C$ of the coil component and stray capacitance C are fixed and only a value of insulation resistance $R_M$ of the magnetic core is changed.

Figure 6A:
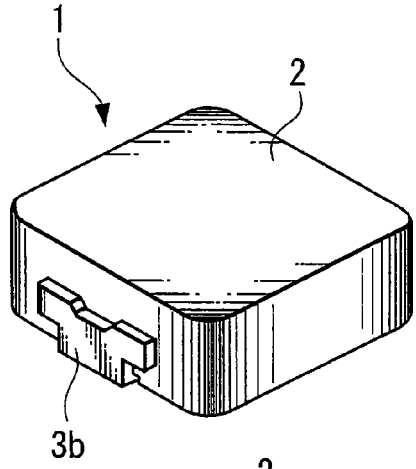
FIGS. 6A to 6E are diagrams of a coil component according to a third embodiment of the present invention.
Figure 6B:
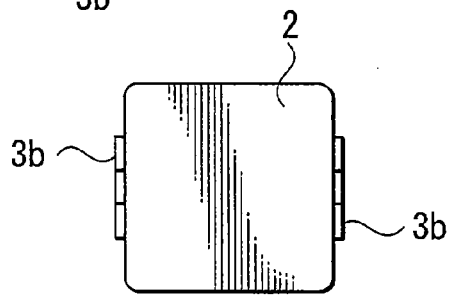
Figure 6C:
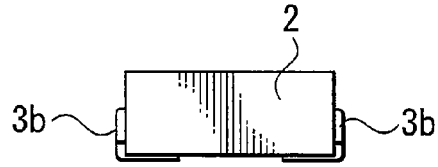
Figure 6D:
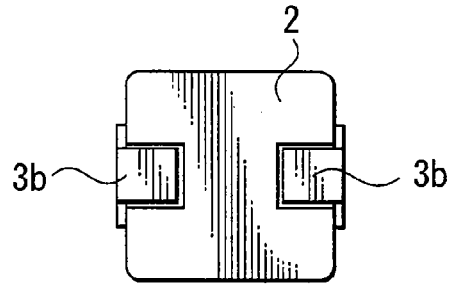
Figure 6E:
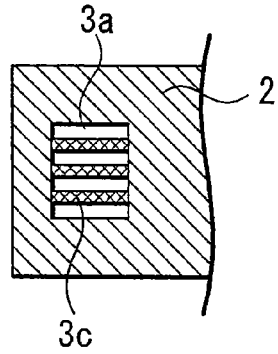

Here, a possibility that an electric current flows in an inter-conductor region 3*c* as shown in FIG. 6E becomes high since the coil portion 3*a* of this embodiment is configured such that the conductor without having the insulation covering film is wound into the air core in the manner winding spirally and also having separation gaps. Accordingly, the insulation resistance $R_M$ of the magnetic core 2 is to be treated as the insulation resistance $R_M$ of the magnetic core that is positioned at the separated and mutually adjacent inter-conductor regions 3*c* in case of this embodiment.

Based on this result, it can be judged that there is no need to apply the insulation processing between the conductor and the magnetic core in this coil component as long as there exists such relation that the insulation resistance $R_M$ of the magnetic core 2 formed by the powder compacting process after mixing the metal type powder and the insulating resin tying agent is equal to or more than 20 times of the peak impedance $Z_O$ of the coil component 1 ($R_M \geqq 20Z_O$) in the coil component of the third embodiment.

Figure 7:
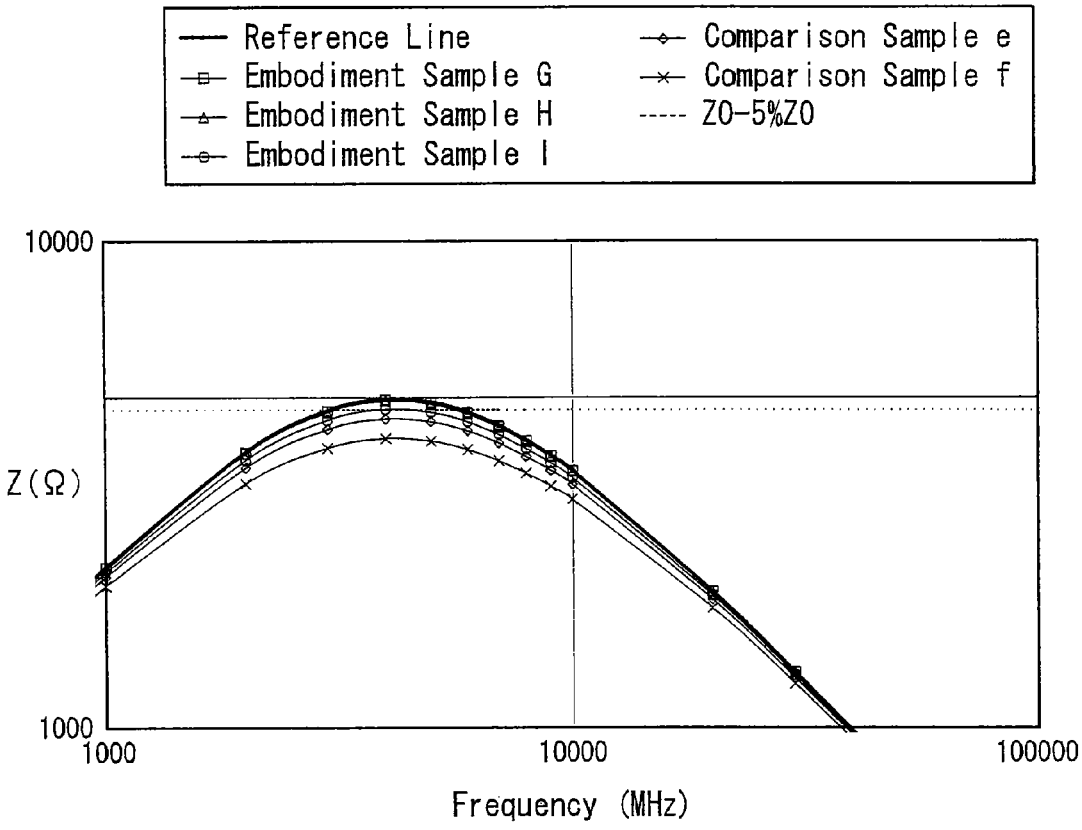
FIG. 7 is a graph showing a frequency characteristic of the impedance Z obtained by a measurement for each of the coil components shown in table 3.

FIG. 7 is a graph showing a frequency characteristic of the impedance Z obtained by the measurement for each of the coil components shown in the table 3.

Here, it can be noticed that the frequency characteristic of the impedance Z in each of the coil components according to

TABLE 3

| Item | Unit | Reference Value | G | H | I | e | f |
|---|---|---|---|---|---|---|---|
| L | μH | 0.36 | 0.36 | 0.36 | 0.36 | 0.36 | 0.36 |
| $R_C$ | mΩ | 1.2 | 1.2 | 1.2 | 1.2 | 1.2 | 1.2 |
| C | pF | 0.004 | 0.004 | 0.004 | 0.004 | 0.004 | 0.004 |
| $R_M$ | Ω | $1.0 \times 10^{10}$ | 995548 | 475300 | 90711 | 43551 | 19252 |
| $Z_0$ | Ω | 4738 | 4716 | 4692 | 4513 | 4312 | 3929 |
| versus Reference Value [%] | | | −0.5 | −1.0 | −4.8 | −9.0 | −17.1 |
| versus Reference Value [Times] | | | 211.1 | 101.3 | 20.1 | 10.1 | 4.9 |

G: Embodiment Sample G, H: Embodiment Sample H, I: Embodiment Sample I, e: Comparison sample e. f: Comparison Sample f At this time, a definition with the ground thereof relating to a range where the insulation resistance $R_M$ of the magnetic core 2 does not affect the peak impedance $Z_O$ of the coil component 1 is similar to the case of the first embodiment.

As is clear from the result of the table 3, the insulation resistance values $R_M$ of the magnetic cores in the coil components of the embodiment samples G through I related to this third embodiment are respectively values of 211 times, 101 times and 20 times of the peak impedance $Z_O$.

In addition, the peak impedance $Z_O$ in each of the embodiment sample G through the embodiment sample I is within the range of −5% from the reference value as shown in the result (versus reference value %) of the table 3.

From the above, it can be considered that an influence ($Z_O$ decrease rate) to be given to the peak impedance $Z_O$ of the coil component by the insulation resistance $R_M$ of each embodiment sample is small in coil components of the embodiment sample G through the embodiment sample I. Therefore, it can be judged that there is no need to apply the insulation processing between the conductor and the magnetic core in the coil components of the embodiment samples G through I.

On the other hand, in case of the coil components of the comparison sample e and comparison sample f whose insulation resistance values $R_M$ of the magnetic cores are respectively 10 times and 5 times of the peak impedance $Z_O$ of each coil component, the value of each peak impedance $Z_O$ becomes larger than the range of −5% from the reference value as shown in the result of the table 3.

This is because it is considered that the influence to be given to the peak impedance $Z_O$ by the insulation resistance $R_M$ of each magnetic core is large in the coil components of the comparison sample e and comparison sample f. Therefore, it can be judged that the insulation processing needs to be applied between the conductor and the magnetic core in the coil components of the comparison sample e and comparison sample f.

the embodiment samples G and H is approximately overlapped with the frequency characteristic of the reference value as is clear from the graph of FIG. 7. Therefore, it can be said that a condition of each coil component of the embodiment sample G and embodiment sample H is close to an ideal value (reference value).

Accordingly, as long as the insulation resistance $R_M$ of the powder compacting magnetic core 2 is equal to or more than 100 times of the peak impedance $Z_O$ of the coil component ($R_M \geqq 100Z_O$), the graph shows the frequency characteristic that is approximately equivalent to the impedance characteristic at the time of assuming the insulation resistance to be sufficiently high for a practical use, and therefore it can be judged to be a further desirable condition.

Fourth Embodiment

Next, a fourth embodiment of the coil component according to the present invention is explained.

FIG. 8 is a diagram of the coil component according to the fourth embodiment of the present invention. FIG. 8A is a perspective view; FIG. 8B is a top view; FIG. 8C is a lateral view; and FIG. 8D is a bottom view. In addition, FIG. 8E is a cross-sectional view of the coil component.

As shown in FIG. 8, a coil component 1 of this embodiment is configured to have a magnetic core 2, a coil portion 3*a*, and a terminal member 3*b* that is connected with this coil portion 3*a*.

The magnetic core 2 is configured such that a drum core 2*a* and a ring core 2*b*, which are made of a ferrite type material, are combined together.

The coil portion 3*a* is formed such that a wire-shaped conductor is wound along a wiring groove formed in an external surface of winding shaft of the drum core 2*a* in a manner winding spirally and also having separation gaps.

The terminal member 3*b* is formed such that there is a planar surface portion. In addition, a part of the terminal member 3*b* is connected with a wire end portion of the coil portion 3*a*, and the planar surface portion of the terminal member 3*b* is arranged along an external wall of the ring core 2*b*.

According to the coil component 1 of this embodiment, an insulation portion such as an insulation coating film is not formed on the coil portion 3*a* and the terminal electrode portion 3*b* which are the conductors, and therefore this coil component 1 is configured such that the conductive materials of the coil portion 3*a* and terminal electrode portion 3*b* contact directly with the magnetic material of the drum core 2*a* or ring core 2*b*.

In table 4, measurement results of the peak impedance $Z_O$ of the coil component are shown in a case that the coil component 1 of this embodiment is measured under a condition that values of inductance L, DC resistance $R_C$ of the coil component and stray capacitance C are fixed and only a value of insulation resistance $R_M$ of the magnetic core is changed.

Figure 8A:
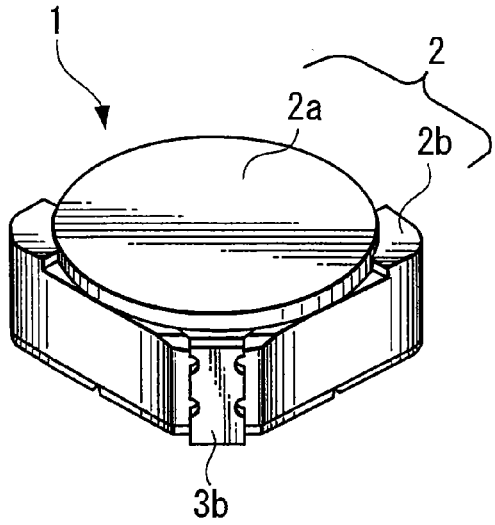
FIGS. 8A to 8E are diagrams of a coil component according to a fourth embodiment of the present invention.
Figure 8B:
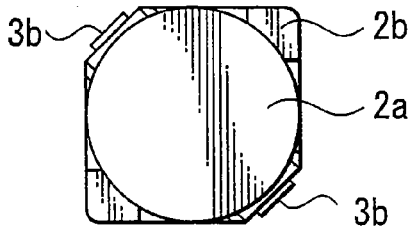
Figure 8C:
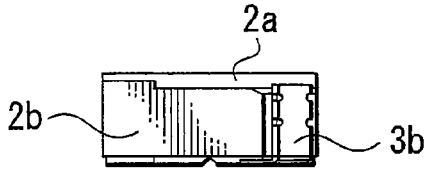
Figure 8D:
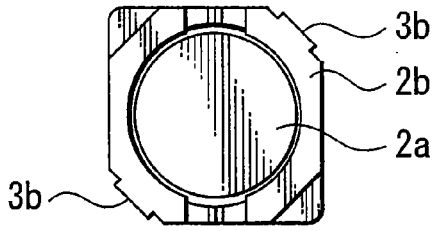
Figure 8E:
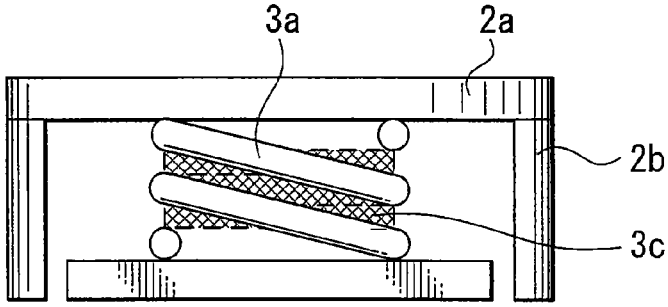

Here, a possibility that an electric current flows in an inter-conductor region 3*c* as shown in FIG. 8E becomes high since the coil portion 3*a* of this embodiment is configured such that the conductor without having the insulation covering film is wound along the wiring groove formed in the external surface of winding shaft of the drum core 2*a* in a manner winding spirally and also having separation gaps. Accordingly, the insulation resistance $R_M$ of the magnetic core of this embodiment is to be treated as the insulation resistance $R_M$ of the magnetic core that is positioned at the separated and mutually adjacent inter-conductor region 3*c*.

TABLE 4

| Item | Unit | Reference Value | J | K | L | g | h |
|---|---|---|---|---|---|---|---|
| L | μH | 1.0 | 1.0 | 1.0 | 1.0 | 1.0 | 1.0 |
| $R_C$ | mΩ | 5.0 | 5.0 | 5.0 | 5.0 | 5.0 | 5.0 |
| C | pF | 0.015 | 0.015 | 0.015 | 0.015 | 0.015 | 0.015 |
| $R_M$ | Ω | $1.0 \times 10^{10}$ | 990911 | 475066 | 93304 | 42461 | 18894 |
| $Z_0$ | Ω | 4872 | 4849 | 4823 | 4642 | 4423 | 4020 |
| versus Reference Value [%] | | | −0.5 | −1.0 | −4.7 | −9.2 | −17.5 |
| versus Reference Value [Times] | | | 205.2 | 98.5 | 20.1 | 9.6 | 4.7 |

J: Embodiment Sample J, K: Embodiment Sample K, L: Embodiment Sample L, g: Comparison sample g. h: Comparison Sample h At this time, a definition with the ground thereof relating to a range where the insulation resistance $R_M$ of the magnetic core 2 does not affect the peak impedance $Z_O$ of the coil component 1 is similar to the case of the first embodiment.

As is clear from the result of the table 4, the insulation resistance values $R_M$ of the magnetic cores in the coil components of the embodiment samples J through L related to this fourth embodiment are respectively values of 205 times, 99 times and 20 times of the peak impedance $Z_O$ of each coil component, and there exists the relation of $R_M \geqq 20Z_O$ in every case.

In addition, the peak impedance $Z_O$ in each of the embodiment sample J through the embodiment sample L is within the range of −5% from the reference value as shown in the result (versus reference value %) of the table 4.

From the above, it can be considered that an influence ($Z_O$ decrease rate) to be given to the peak impedance $Z_O$ of the coil component by the insulation resistance $R_M$ of each embodiment sample is small in each coil component of the embodiment sample J through the embodiment sample L. Therefore, it can be judged that there is no need to apply the insulation processing between the conductor and the magnetic core in the coil components of the embodiment samples J through L.

On the other hand, in case of the coil components of the comparison sample g and comparison sample h whose insulation resistance values $R_M$ of the magnetic cores are respectively 10 times and 5 times of the peak impedance $Z_O$ of each coil component, the value of each peak impedance $Z_O$ becomes larger than the range of −5% from the reference value as shown in the result of the table 4.

This is because it is considered that the influence to be given to the peak impedance $Z_O$ by the insulation resistance $R_M$ of each magnetic core becomes large in the coil components of the comparison sample g and comparison sample h. Therefore, it can be judged that the insulation processing needs to be applied between the conductor and the magnetic core in the coil components of the comparison sample g and comparison sample h.

Based on this result, it can be judged that there is no need to apply the insulation processing between the conductor and the magnetic core in the coil component of the fourth embodiment as long as there exists such relation that the insulation resistance $R_M$ of the magnetic core 2 that is positioned at the separated and mutually adjacent inter-conductor region in the ferrite type drum core 2*a* is equal to or more than 20 times of the peak impedance $Z_O$ of the coil component 1 ($R_M \geqq 20Z_O$).

Figure 9:
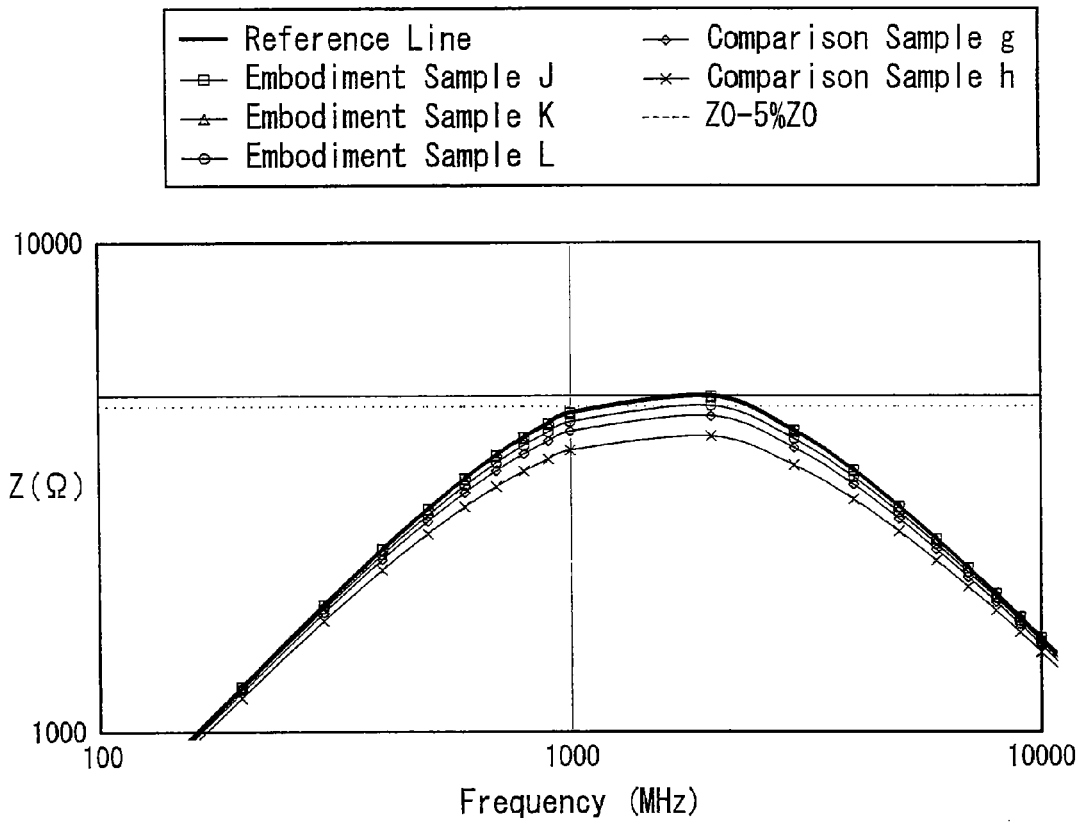
FIG. 9 is a graph showing a frequency characteristic of the impedance Z obtained by a measurement for each of the coil components shown in table 4.

FIG. 9 is a graph showing a frequency characteristic of the impedance Z obtained by the measurement for each of the coil components shown in the table 4. It should be noted that a solid line parallel with a lateral axis shown in the graph indicates a reference line and a dashed line indicates the range of −5% from the reference line.

Here, it can be noticed that the frequency characteristic of the impedance Z in each of the coil components according to the embodiment samples J and K is approximately overlapped with the frequency characteristic of the reference value as is clear from the graph of FIG. 9. Therefore, it can be judged that a condition of each coil component of the embodiment sample J and embodiment sample K is close to an ideal value (reference value).

Accordingly, as long as the insulation resistance $R_M$ of the magnetic core 2 is equal to or more than 100 times of the peak impedance $Z_O$ of the coil component ($R_M \geqq 100Z_O$), the graph shows the frequency characteristic that is approximately equivalent to the impedance characteristic at the time of assuming the insulation resistance to be sufficiently high for a practical use, and therefore it can be said to be a further desirable condition.

According to the coil component related to the embodiment of the present invention, manufacturing costs of the coil component can be reduced since there is no need to provide the insulation member between the magnetic core and the coil portion and thereby a process of forming the insulation member such as the insulation coating film onto the conductor or the magnetic core can be eliminated.

In addition, according to the coil component related to the embodiment of the present invention, the coil component is used within the range where the insulation resistance $R_M$ of the magnetic core does not affect the peak impedance $Z_O$ of the coil component and the electric current flowing in the coil component can be passed only through the conductor even without applying the insulation processing between the conductor and the magnetic core which are used for the coil component, and therefore it is possible to secure the desired electric characteristic of the coil component.

Further, according to the coil component related to the embodiment of the present invention, it is possible to prevent an increase in number of processes caused due to the necessity for forming the insulation coating film at the time of manufacturing the conductor as well as an increase in cost related thereto, and/or a necessity for a process of removing the insulation coating film corresponding to a region that becomes the terminal electrode portion or a region that connects with the terminal electrode out of the insulation coating film that is formed over the whole area of the conductor surface as well as an increase in process and cost caused thereby.

Moreover, according to the coil component related to the embodiment of the present invention, there is no need to perform coating of the insulating resin on the surface of the magnetic core in order to secure the insulation between the magnetic core and the coil portion, and therefore it is possible to eliminate such a problem as an increase in coating process accompanied therewith and cost related thereto, or an insulation failure due to a variation in thickness of the insulation coating film.

It should be noted that the coil component of the present invention is not limited to the above-described each embodiment but it is obvious that various alterations and modifications are possible in materials, configurations and the like beside those described herein without departing from the configuration of the present invention.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A coil component comprising:

a magnetic core that is made of a magnetic material; and a terminal electrode portion and a coil portion that are made of a conductive material, wherein the coil component is configured such that said magnetic material and said conductive material contact with each other, and there is a relation of $$R_M \geqq 20 Z_O$$

when an insulation resistance of said magnetic core is $R_M$ (Ω) and a peak impedance of said coil component is $Z_0$ (Ω).

2. A coil component according to claim 1, wherein said coil portion is composed of a flat board-shaped member.

* * * * *

UNITED STATES PATENT AND TRADEMARK OFFICE

CERTIFICATE OF CORRECTION

PATENT NO. : 7,397,336 B2
APPLICATION NO. : 11/556848
DATED : July 8, 2008
INVENTOR(S) : Mitsugu Kawarai It is certified that error appears in the above-identified patent and that said Letters Patent is hereby corrected as shown below:

ON THE TITLE PAGE

"(73) Assignee: Sumida Electric Co., Ltd., Tokyo (JP)" should be

--(73) Assignee: Sumida Corporation, Tokyo (JP)--

Signed and Sealed this

Twenty-seventh Day of January, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,397,336 B2
APPLICATION NO. : 11/556848
DATED : July 8, 2008
INVENTOR(S) : Mitsugu Kawarai It is certified that error appears in the above-identified patent and that said Letters Patent is hereby corrected as shown below:

ON THE TITLE PAGE item

"(73) Assignee: Sumida Electric Co., Ltd., Tokyo (JP)" should be

--(73) Assignee: Sumida Corporation, Tokyo (JP)--

Signed and Sealed this

Tenth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,397,336 B2
APPLICATION NO. : 11/556848
DATED : July 8, 2008
INVENTOR(S) : Mitsugu Kawarai It is certified that error appears in the above-identified patent and that said Letters Patent is hereby corrected as shown below:

This certificate vacates the Certificate of Correction issued February 10, 2009. The certificate is a duplicate of the Certificate of Correction issued January 27, 2009. All requested changes were included in the Certificate of Correction issued January 27, 2009.

Signed and Sealed this

Seventeenth Day of March, 2009

JOHN DOLL
*Acting Director of the United States Patent and Trademark Office*